US007912401B2

(12) United States Patent
Inoue

(10) Patent No.: US 7,912,401 B2
(45) Date of Patent: Mar. 22, 2011

(54) CLEANING DEVICE AND IMAGE FORMING APPARATUS INCLUDING THE SAME

(75) Inventor: Mutsumi Inoue, Osaka (JP)

(73) Assignee: KYOCERA MITA Corporation, Osaka (JP)

( * ) Notice: Subject to any disclaimer, the term of this patent is extended or adjusted under 35 U.S.C. 154(b) by 0 days.

(21) Appl. No.: 12/551,756

(22) Filed: Sep. 1, 2009

(65) Prior Publication Data

US 2010/0104318 A1 Apr. 29, 2010

(30) Foreign Application Priority Data

Oct. 28, 2008 (JP) ..... 2008-276824

(51) Int. Cl.
*G03G 15/16* (2006.01)
*G03G 21/00* (2006.01)

(52) U.S. Cl. ..... 399/101; 399/343; 399/345

(58) Field of Classification Search ..... 399/71, 399/101, 345, 350, 351, 358
See application file for complete search history.

(56) References Cited

U.S. PATENT DOCUMENTS 7,127,201 B2 * 10/2006 Takenouchi et al. ..... 399/297

FOREIGN PATENT DOCUMENTS

JP 2002-207403 7/2002

* cited by examiner

*Primary Examiner* — Hoang Ngo
(74) *Attorney, Agent, or Firm* — Frommer Lawrence & Haug LLP

(57) ABSTRACT

A cleaning device cleans an image bearing member bearing a toner image to be transferred at a transfer position onto a sheet. The device includes a cleaning member provided on a downstream side with respect to the transfer position in a movement direction in which the image bearing member moves and configured to collect residual toner from the image bearing member, a cleaning assist member provided on an upstream or downstream side in the movement direction with respect to the cleaning member and configured to be pressed against the image bearing member to rub off the toner from the image bearing member, a cleaning mechanism configured to move the cleaning assist member away from the image bearing member at a predetermined timing to remove the toner adhered to the cleaning assist member, and a housing that houses the cleaning member, the cleaning assist member, and the cleaning mechanism.

18 Claims, 9 Drawing Sheets

CLEANING DEVICE AND IMAGE FORMING APPARATUS INCLUDING THE SAME

This application is based upon and claims the benefit of priority from the corresponding Japanese Patent application No. 2008-276824, filed Oct. 28, 2008, the entire contents of which are incorporated herein by reference.

FIELD OF THE INVENTION

The present invention relates to cleaning devices configured to collect residual toner on image bearing members remaining after the transfer of toner images formed on the image bearing members onto sheets and/or an image forming apparatus that includes one or more such cleaning devices.

BACKGROUND OF THE INVENTION

Known image forming apparatuses, such as color printers, operate by forming toner images of colors on a plurality of image bearing members. The images are then transferred (i.e., primary transfer) onto another image bearing member so that a color toner image is formed. The color toner image is subsequently transferred (i.e., secondary transfer) onto a sheet. Such an image forming apparatus, generally, includes a cleaning device that collects or removes residual toner on the image bearing member after the transfer onto a sheet (secondary transfer).

An illustrative cleaning device includes a fur brush (an upstream fur brush) provided at a downstream position, with respect to a secondary transfer position, on a path along which the image bearing member moves, another fur brush (a downstream fur brush) provided at a more downstream position than the upstream fur brush, and a bias roller (a cleaning assist member) provided in contact with the image bearing member between the secondary transfer position and the upstream fur brush.

The bias roller is positively biased in an effort the charge of the residual toner on the image bearing member is both charged positively and uniformly. The positively charged residual toner is then removed by the upstream fur brush that is negatively biased. Residual toner failed to be removed by the upstream fur brush is removed by the downstream fur brush that is positively biased. In this manner, residual toner is removed from the image bearing member, whereby the image bearing member is cleaned.

In the foregoing cleaning device, toner adhered to the upstream and downstream fur brushes is rubbed off by cleaning members. However, the bias roller (cleaning assist member) is not cleaned. Therefore, if residual toner adheres to the bias roller, the bias roller is contaminated. Further, if the contamination on the bias roller adheres back to the image bearing member, image failure may occur on the sheet. Moreover, if such contamination scatters to the outside of the cleaning device, the internal components of the image forming apparatus may be contaminated. Particularly, when a sheet conveyance path is provided below the cleaning device, such contamination may adhere to a sheet that is being conveyed, leading to image failure.

SUMMARY OF THE INVENTION

It is an object of the present invention to provide a cleaning device configured to clean a cleaning assist member. Further, some embodiments may include an image forming apparatus including a cleaning device. In some embodiments, the cleaning device may suppress the occurrence of image failure and internal contamination.

According to an embodiment, a cleaning device may be provided that cleans an image bearing member bearing a toner image which is to be transferred at a transfer position onto a sheet. Some embodiments of the device may include, but are not limited to a cleaning member, a cleaning assist member, a cleaning mechanism, and/or a housing. In an embodiment, the cleaning member may be provided downstream of the transfer position with respect to movement of the image bearing member. In some embodiments, the cleaning member may be configured to collect residual toner from the image bearing member. An embodiment of the cleaning assist member may be provided on the upstream side and/or the downstream side in the direction of movement with respect to the cleaning member and may be configured to be pressed against the image bearing member so as to rub off the residual toner from the image bearing member. A cleaning mechanism may be configured to move the cleaning assist member away from the image bearing member according to a predetermined timing so as to remove the residual toner adhered to the cleaning assist member. In some embodiments, a housing may house the cleaning member, the cleaning assist member, and the cleaning mechanism.

In some embodiments, the predetermined timing may comprise variable timing which may depend on the occurrence of one or more events. In various embodiments, such events to establish predetermined timings may include, but are not limited to completion of image output jobs, during calibration, and/or in the event of sheet jamming. The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and is by no way limiting. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
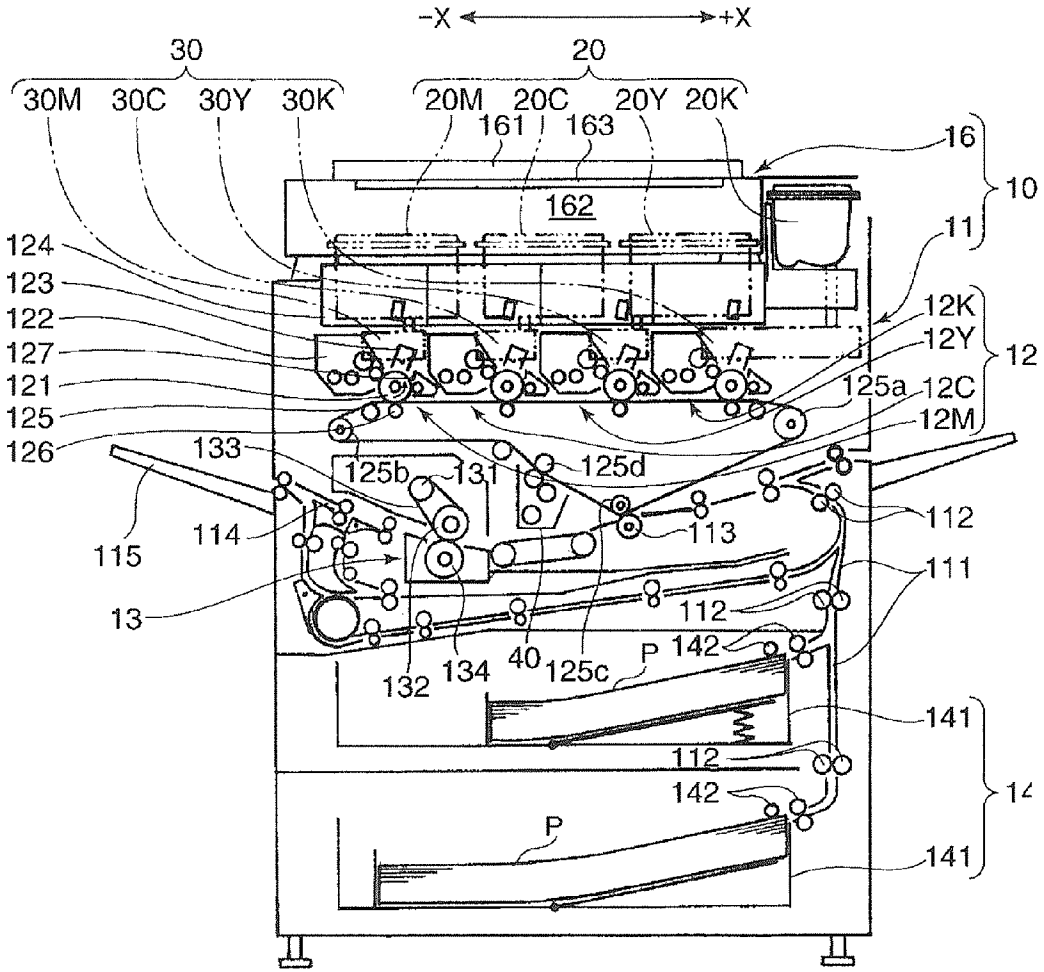
FIG. 1 is a front cross-sectional view showing the overall configuration of an image forming apparatus including a cleaning device according to a general embodiment.

Embodiments will now be described with reference to the drawings. FIG. 1 is a front cross-sectional view showing the internal configuration of an image forming apparatus including a cleaning device according to a general embodiment. An image forming apparatus may be used as a copier for color printing. Image forming apparatus 10 includes a box-shaped apparatus body 11 and an image reading device 16 provided at the top of the apparatus body 11. The image reading device 16 reads a document as an image.

As shown in FIG. 1 apparatus body 11 houses image forming section 12, fixing section 13, and sheet storage section 14. The image forming section may form an image in accordance with image information on a document read by the image reading device 16. The fixing section 13 may fix the image formed and transferred onto a sheet P by the image forming section 12. In some embodiments, sheet storage section 14 stores sheets onto which the image is to be transferred. Alternatively, sheets may be feed from an external tray. Sheets, as used herein, may include any material on which an image may be printed including, but not limited to paper, transparencies and any material known in the art.

Image reading device 16 includes document presser 161 provided at the top of apparatus body 11 in an openable/closable manner, and optical unit 162 provided in an upper portion of apparatus body 11 and facing document presser 161 with contact glass 163 interposed therebetween. Contact glass 163 has a flat surface with slightly smaller dimensions than document presser 161 so that the surface of the document placed thereon can be read. Document presser 161 opens and closes by being turned in one direction and the reverse direction about an axis defined along one side at the top face of apparatus body 11, the one side being one of the constituents of image reading device 16.

In some embodiments, an optical unit may include, but is not limited to one or more light sources, a plurality of mirrors, one or more lens units, a charge-coupled device (hereinafter "CCD"), and/or other devices known in the art. FIG. 1 depicts optical unit 162 may include, although not shown, light sources, a plurality of mirrors, a lens unit, a charge-coupled device (CCD), and so forth. Light emitted from the light source may be reflected by the surface of the document. The reflected light may be further reflected by the mirrors, transmitted through the lens unit, and input as document information to the CCD. The document information that has been input as an analog quantity to the CCD may be converted into a digital signal, and is stored in a specific storage device.

The image forming section 12 forms a toner image on a sheet P fed from the sheet storage section 14, and includes a magenta unit 12M, a cyan unit 12C, a yellow unit 12Y, and a black unit 12K arranged in that order from the upstream side (the left side in FIG. 1) to the downstream side. In some embodiments, an order of the units may vary. For example, the units may be arranged in reverse or in any order known in the art. The units of the image forming section may include an image bearing member (e.g., photosensitive drum). For example, each of the units 12M, 12C, 12Y, and 12K may include photosensitive drum 121 and developer 122. The photosensitive drums 121 receive toner applied thereto by the respective developers 122 while rotating counterclockwise as shown in FIG. 1. The toner is supplied to developers 122 from corresponding toner containers 20. As shown in FIG. 1, in some embodiments toner containers 20 may be positioned on the front and right sides of the apparatus body 11.

Toner containers 20 may be provided for each color used. For example, FIG. 1 depicts magenta toner container 20M, cyan toner container 20C, yellow toner container 20Y, and black toner container 20K. Toner containers 20M, 20C, 20 Y, 20K provide toner of the respective colors to the developers 122 (e.g., magenta developer 122M, cyan developer 122C, yellow developer 122Y, and black developer 122K). In some embodiments, developers included in the units 12M, 12C, 12Y, and 12K, may be positioned above image forming section 12. Further, developers 122M, 122C, 122Y, 122K may be removed from apparatus body 11 in some embodiments.

As shown in FIG. 1, chargers 123 are provided above the respective photosensitive drums 121 (e.g., magenta drum 121M, cyan drum 121C, yellow drum 121Y, and black drum 121K). In some embodiments, exposure device 124 may be provided above each set of charger 123 and developer 122. In some embodiments, the peripheral surfaces of photosensitive drums 121 are uniformly charged by respective chargers 123. The charged peripheral surfaces of photosensitive drums 121 are irradiated with laser light from respective exposure devices 124 in accordance with pieces of data on images of the respective colors that are input from image reading device 16, whereby individual electrostatic latent images are formed. Subsequently, developers 122 apply toner of the respective colors to the electrostatic latent images. Thus, toner images are formed on the peripheral surfaces of photosensitive drums 121.

As shown in FIG. 1, a transfer belt (e.g., an image bearing member) 125 may be provided below photosensitive drums 121. Transfer belt 125 is stretched between driving roller 125*a*, following roller 125*b*, secondary-transfer counter roller 125*c*, and other rollers such that transfer belt 125 is in contact with the peripheral surfaces of photosensitive drums 121. In some embodiments, transfer belt 125 rotates clockwise around driving roller 125*a* and following roller 125*b*, synchronously with photosensitive drums 121, while being pressed against the peripheral surfaces of photosensitive drums 121 by primary-transfer rollers 126 provided in correspondence with photosensitive drums 121.

In parallel with the rotation of transfer belt 125, a magenta toner image is first transferred from photosensitive drum 121 of magenta unit 12M onto transfer belt 125. Subsequently, a cyan toner image is transferred from photosensitive drum 121 of cyan unit 12C so as to be overlaid onto the transferred magenta toner image on transfer belt 125. Likewise, yellow and black toner images are transferred in that order from yellow and black units 12Y and 12K so as to be overlaid onto the previously transferred toner images. Thus, a color toner image is formed on transfer belt 125. The color toner image on transfer belt 125 may be further transferred onto a sheet P conveyed from sheet storage section 14. In alternate embodiments, an order of the colors may vary. Further, some embodiments may include the use of additional or fewer colors.

Referring to FIG. 1, cleaning devices 127 are shown to the right of the respective photosensitive drums 121. Cleaning devices 127 remove residual toner from the peripheral surfaces of the respective photosensitive drums 121 so as to clean photosensitive drums 121. The peripheral surfaces of photosensitive drums 121 cleaned by cleaning devices 127 face the respective chargers 123 again for next charging. Waste toner removed from the peripheral surfaces of the photosensitive drums 121 by the cleaning devices 127 may be collected through a specific path into a toner collecting bottle (not shown). In alternate embodiments, cleaning devices may be provided in any position proximate the photosensitive drums.

In an embodiment depicted in FIG. 1, sheet conveyance path 111 extends from an upper right position of sheet storage section 14 to a position below image forming section 12. Pairs of conveyance rollers 112 are provided at appropriate positions on sheet conveyance path 111. Conveyance rollers may convey each sheet P fed from sheet storage section 14 toward a position below transfer belt 125. As shown in FIG. 1, secondary-transfer roller 113 is also provided on sheet conveyance path 111 at a position facing the secondary-transfer counter roller 125*c*. In some embodiments, secondary-transfer roller 113 is in contact with transfer belt 125. During conveyance, sheet P may be positioned between transfer belt 125 and secondary-transfer roller 113. In some embodiments, sheet P may be compressed between the two surfaces of the transfer belt and the secondary transfer roller. For example, the toner image on transfer belt 125 may be transferred onto the sheet P when sheet P is nipped between transfer belt 125 and secondary transfer roller 113.

Fixing section 13 fixes the toner image transferred onto sheet P by image forming section 12. Fixing section 13 includes heating roller 131, fixing roller 132 facing heating roller 131, fixing belt 133 stretched between heating roller 131 and fixing roller 132, and pressing roller 134 facing fixing roller 132 with fixing belt 133 interposed therebetween. The heating roller may include a heat source. Heat sources used may include, but are not limited to electrical heaters and/or radiant heaters, such as halogen lamps, or any heat sources known in the art. Sheet P on which the color image is fixed may be conveyed along sheet discharge path 114 extending from an upper position of fixing section 13 and is discharged toward discharge tray 115. In some embodiments, the discharge tray may be provided on the left wall of the apparatus body.

Cleaning device 40 is provided between secondary-transfer roller 113 and following roller 125*b* along transfer belt 125. In alternate embodiments, a cleaning device may be positioned at any point along the transfer belt. Cleaning device 40 may remove any residual toner on transfer belt 125. Some embodiments may include multiple cleaning devices positioned along the transfer belt. Further, the cleaning device may collect the residual toner in some embodiments. For example, cleaning device 40 shown in FIG. 1 collects, or removes, residual toner remaining on transfer belt 125 after the transfer of the toner image onto the sheet P performed by secondary-transfer roller 113. Subsequently, the cleaned transfer belt may be compressed between photosensitive drums 121 and primary-transfer rollers 126 again to allow another toner image to be transferred via primary transfer to the transfer belt.

In some embodiments, sheet storage section 14 includes sheet trays 141 provided below image forming section 12 and fixing section 13. Sheet trays 141 are removably attached to apparatus body 11 and each store a stack of sheets P. FIG. 1 depicts two sheet trays 141. Alternatively, three or more sheet trays 141 may be provided. Some embodiments may include only one sheet tray 141.

Sheets P may be fed one by one from any of the sheet trays 141 when corresponding pickup rollers 142 are driven. Each sheet P fed in this manner is conveyed along sheet conveyance path 111 toward the nip between secondary-transfer roller 113 of image forming section 12 and transfer belt 125, and the color toner image formed on transfer belt 125 is transferred onto the sheet P. The sheet P after being subjected to the transfer is conveyed as described above.

Figure 2:
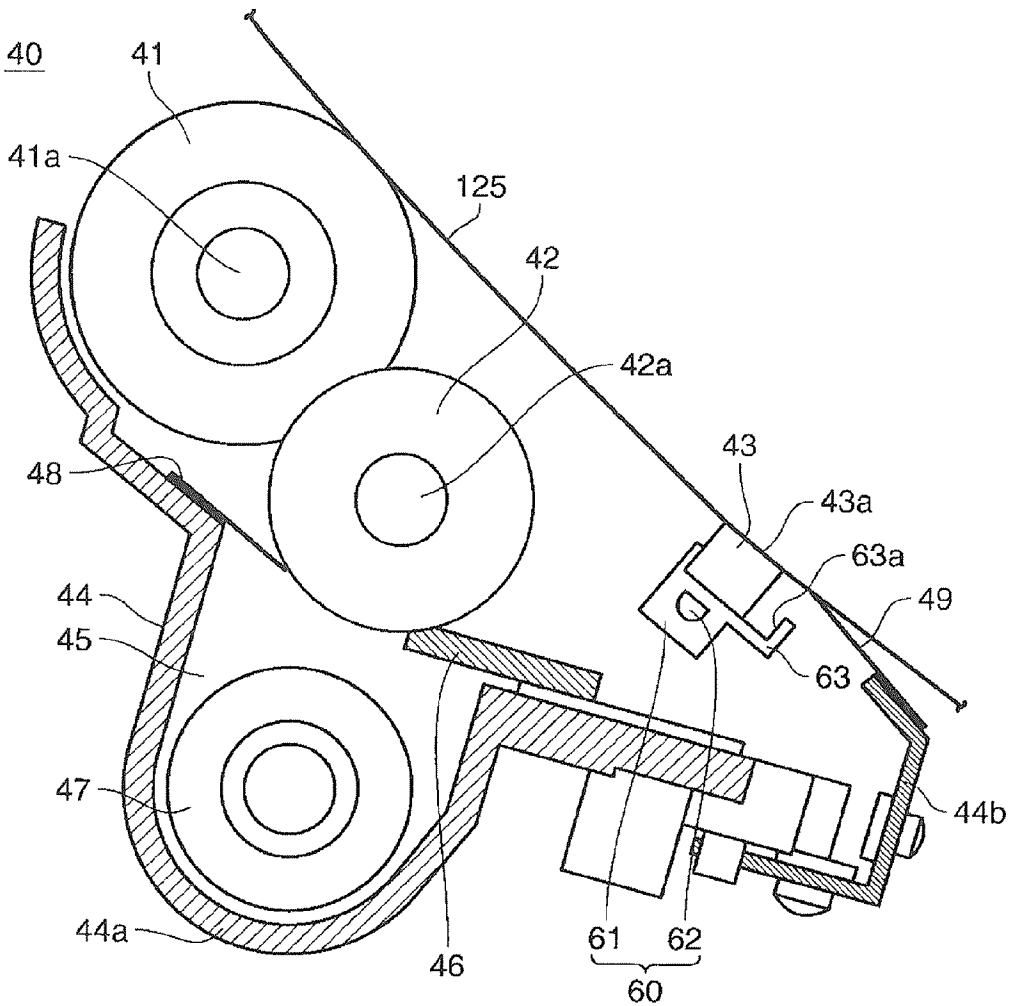
FIG. 2 schematically shows major elements of a cleaning device according to an embodiment, in a state where a cleaning assist member is in contact with an image bearing member.

In some embodiments, as shown in FIG. 1 cleaning device 40 collects residual toner on transfer belt 125 remaining after the secondary transfer of a toner image performed by secondary-transfer roller 113. Secondary transfer occurs when an image is transferred from the transfer belt to a sheet being conveyed along the sheet conveyance path. FIG. 2 schematically shows elements of cleaning device 40, leaning device 40 includes fur brush roller 41, sweep roller 42, and cleaning assist member 43. In some embodiments, the fur brush roller may be in contact with the transfer belt. Sweep roller 42 may be provided at an oblique lower position (at lower right in FIG. 2) with respect to the fur brush roller 41 and in contact with the peripheral surface of the fur brush roller 41. As shown in FIG. 2, cleaning assist member 43 is provided on the upstream side with respect to the fur brush roller 41 and on the downstream side with respect to the secondary-transfer roller 113 (shown in FIG. 1) in the direction of transfer belt 125. For example, transfer belt 125 moves between fur brush roller 41, secondary-transfer roller 113, and housing 44 which contains fur brush roller 41, sweep roller 42, and cleaning assist member 43.

Figure 8:
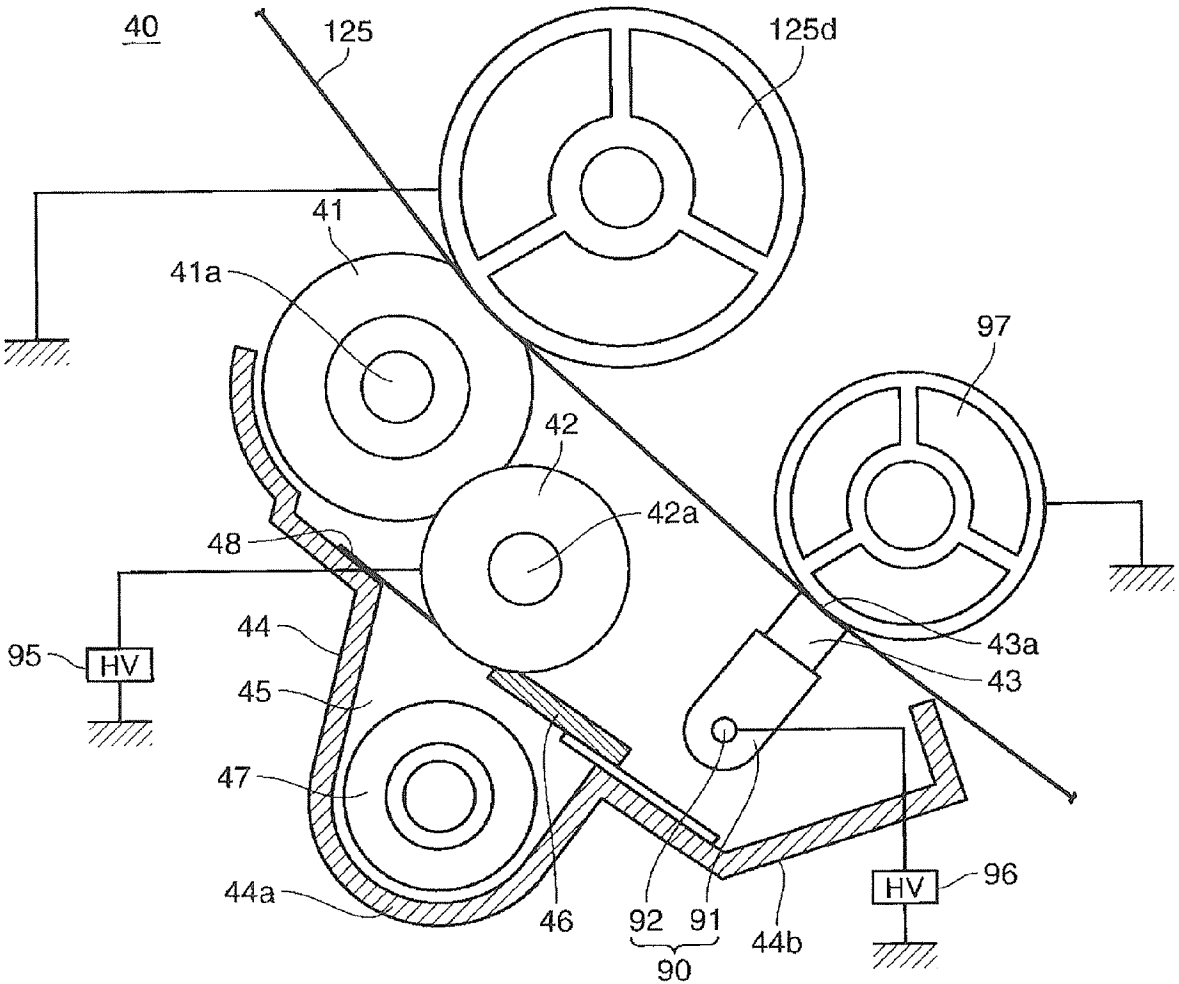
FIG. 8 schematically shows major elements of a cleaning device according to an embodiment, in a state where a cleaning assist member is in contact with an image bearing member.
Figure 9:
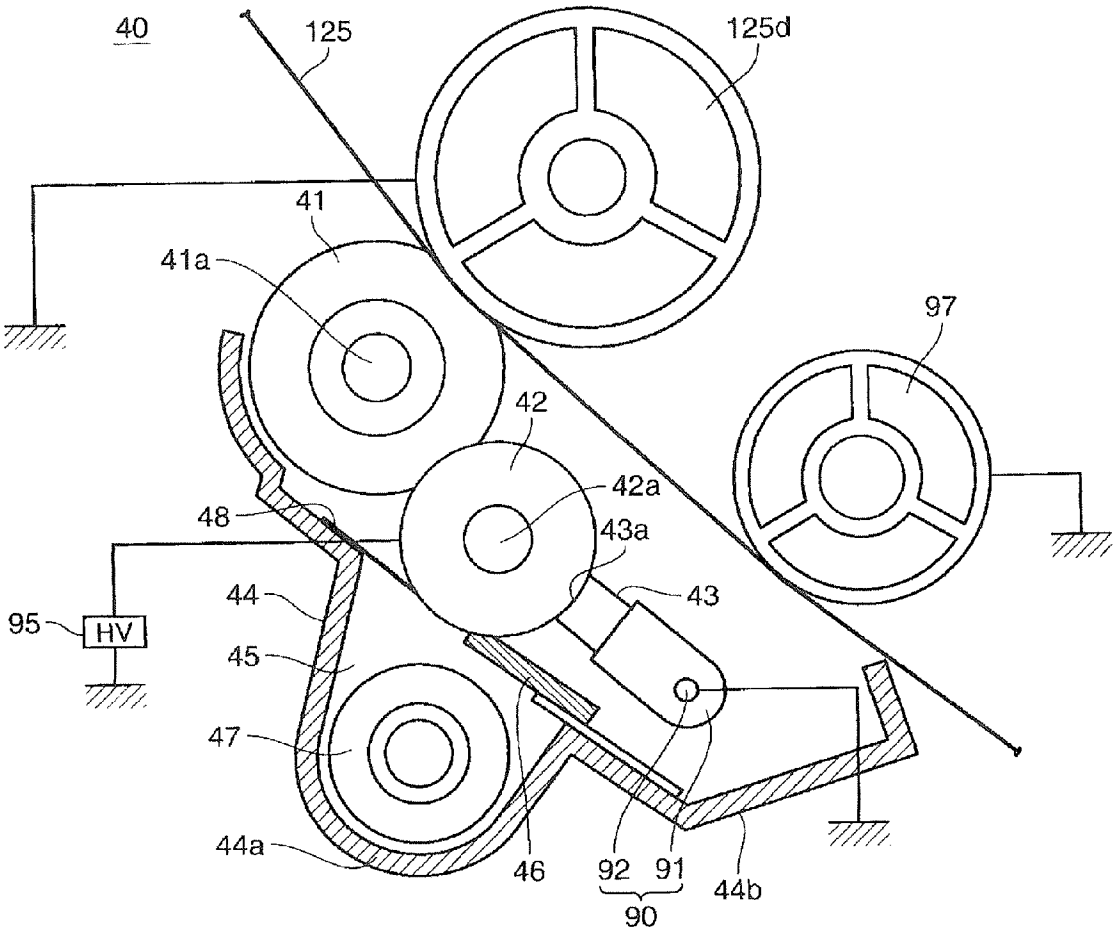
FIG. 9 schematically shows the major elements of the cleaning device according to the embodiment depicted in FIG. 8, in a state where the cleaning assist member is away from the image bearing member.

In some embodiments, the fur brush roller may be electrically conductive. Further, in some embodiments the fur brush roller may include a number of brush hairs evenly embedded in the peripheral surface thereof. In some embodiments, the polarity of the fur brush roller may be opposite to the polarity of the residual toner on the transfer belt 125 remaining after secondary transfer. For example, the toner used in forming toner images may be biased at a secondary transfer position with a positive polarity by the secondary-transfer roller 113 (shown in FIG. 1). Accordingly, the residual toner on transfer belt 125 remaining after secondary transfer is positively charged. Therefore, by negatively biasing the fur brush roller, the residual toner can be electrically collected onto the fur brush roller. In some embodiments, as shown in FIGS. 8 and 9 fur brush roller 41 faces a counter roller 125*d* with the transfer belt 125 interposed therebetween. Counter roller 125*d* is positioned proximate transfer belt 125. In some embodiments, the counter roller may be in contact with the transfer belt. Additionally, some embodiments may include a counter roller which is grounded.

Sweep roller 42 is a shaft roller made of, for example, iron. Alternatively, sweep rollers may be made of a material including, but not limited to metals, composites, plastics and/or any materials known in the art. Sweep roller 42 has a rotating shaft 42*a* substantially parallel to rotating shaft 41*a* of fur brush roller 41. Sweep roller 42 contacts the peripheral surface of fur brush roller 41, thereby receiving the residual toner collected by fur brush roller 41. Housing 44 has a portion of bottom member 44*a* thereof forming waste-toner chamber 45. Waste-toner chamber 45 is positioned below sweep roller 42 and temporarily stores the residual toner received by the sweep roller 42. In some embodiments, cleaning blade 46 may be included in housing 44 at an appropriate position. Cleaning blade 46 may be secured in contact with peripheral surface of sweep roller 42. The residual toner on sweep roller 42 may be scraped off the peripheral surface of sweep roller 42 by cleaning blade 46 into the waste-toner chamber 45. The residual toner may than be conveyed by waste-toner screw 47 provided in waste-toner chamber 45 to a waste-toner bottle (not shown). In some embodiments, the housing may include seal members at various positions. For example, FIGS. 2-9 depict housing 44 contacting seal member 48. Seal member 48 may contact the peripheral surface of sweep roller 42. Thus, a seal member may inhibit scattering of the residual toner. For example, seal member 48 may inhibit the residual toner in waste-toner chamber 45 from scattering around fur brush roller 41 and sweep roller 42. As in FIGS. 8 and 9 referred to below, sweep roller 42 may be negatively biased, instead of fur brush roller 41. In either case, residual toner on transfer belt 125 can be collected.

As shown in FIG. 2 cleaning assist member 43 has contact surface 43*a* at which cleaning assist member 43 may contact transfer belt 125. In some embodiments, the cleaning assist member may be pressed against the transfer belt, thereby assisting the collection of residual toner from the transfer belt. An embodiment of contact surface 43*a* may include a rubbing member. Contact surfaces may include, but are not limited to rough surfaces, a conductive flocked sheet, an insulated flocked sheet, a conductive plate, a brush roller in which a conductive pile sheet is wrapped around a roller, a brush roller in which an insulated pile sheet is wrapped around a roller or any other surface known in the art. For example, a contact surface may include a flocked sheet having a number of brush hairs embedded. In some embodiments, the contact surfaces may be bonded to the contact member, such as a flocked sheet may be bonded to the contact member. An example of the flocked sheet may include a layer having conductive pile thread woven into the layer to form the flocked sheet. When the flocked sheet is pressed against transfer belt 125, residual toner on transfer belt 125 may be rubbed off and fall into housing 44. Side member 44*b* of housing 44 is provided with seal member 49 on the upstream side with respect to the direction in which transfer belt 125 moves. Seal member 49 is in contact with transfer belt 125, and may inhibit scattering of the residual toner outside of cleaning device 40.

In cleaning device 40 configured as described above, if cleaning assist member 43 is contaminated with residual toner adhered thereto, the residual toner may adhere to the transfer belt. In particular, when cleaning assist member 43 is contaminated with a large amount of toner, the residual toner collected by cleaning assist member 43 may adhere to transfer belt 125. This may occur during calibration or in the event of sheet jamming. If the primary transfer and/or the secondary transfer are performed with transfer belt 125 having residual toner adhered to it, image failure may occur on the sheet. To avoid image failure, an embodiment of the cleaning device may include a cleaning mechanism configured to clean the cleaning assist member by removing residual toner adhered to the cleaning assist member. This cleaning mechanism allows the cleaning assist member to be moved away from the transfer belt 125 at predetermined times (e.g., at fixed or irregular time intervals, and/or upon or after the occurrence of one or more events, such as the elapsing of a predetermined time period, output of a predetermined number of printed sheets, calibration, and/or sheeting jamming etc. Then, the cleaning assist member may be cleaned. Referring to FIGS. 2 to 9, embodiments of the cleaning mechanism will now be described.

Figure 3:
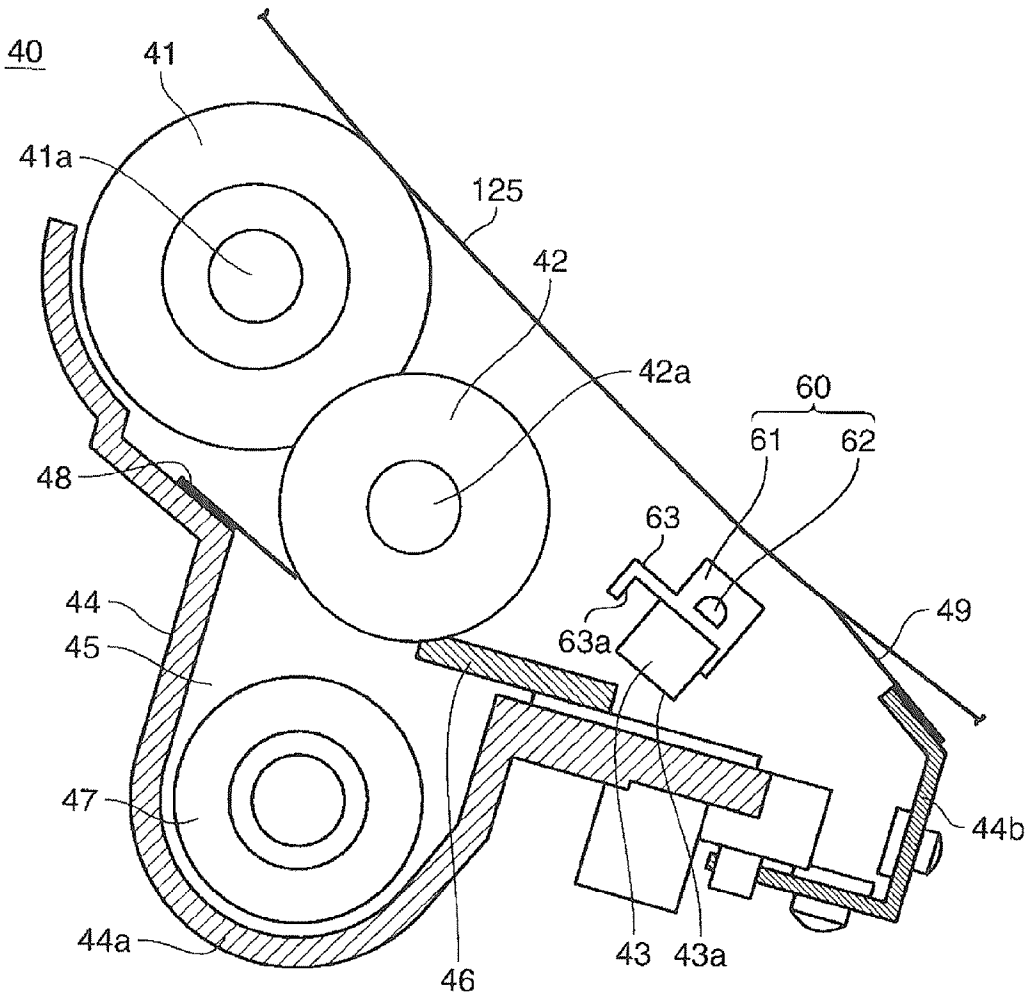
FIG. 3 schematically shows the major elements of the cleaning device according to the embodiment depicted in FIG. 2, in a state where the cleaning assist member is away from the image bearing member.

FIGS. 2 and 3 show an embodiment of a cleaning mechanism. Specifically, FIG. 2 depicts cleaning mechanism 60 where the cleaning assist member 43 is in contact with the transfer belt 125. In contrast, FIG. 3 depicts a cleaning mechanism where the cleaning assist member 43 is moved away from the transfer belt 125 by the cleaning mechanism 60. As shown in FIGS. 2 and 3, cleaning mechanism 60 includes support member 61 that supports the cleaning assist member 43 such that the contact surface 43*a* (e.g., rubbing member, or flocked sheet) of cleaning assist member 43 is in contact with transfer belt 125, and rotating shaft 62 extending through an opening provided in support member 61. Support member 61 includes toner receiver 63 having a shape that allows residual toner rubbed off by the cleaning assist member 43 to lie thereon. The shape of the toner receiver may vary. Rotating shaft 62 may include a motor shaft rotated (clockwise in the drawings) by a motor (not shown). Motors used may include any motor known in art, such as a single-revolution-clutch motor. As shown in FIG. 2, the axis of rotating shaft 62 may extend substantially parallel to the rotating shafts 41*a* and 42*a* of the fur brush roller 41 and the sweep roller 42.

In an embodiment of the cleaning mechanism, when rotating shaft 62 rotates according to a predetermined timing, the cleaning assist member 43 is moved away from the transfer belt 125 as is shown in FIG. 3. For example, the predetermined time may be after a predetermined time has passed. Alternatively or additionally, the rotating shaft may be configured to rotate at pre-determined time points. The rotation of the rotating shaft is configured to allow contact surface 43*a* of cleaning assist member 43 to be oriented to face downward, together with opening 63*a* of toner receiver 63. Accordingly, residual toner adhered to contact surface 43*a* of cleaning assist member 43 and residual toner in toner receiver 63 may fall down under their own weight. The fallen residual toner may be inhibited from scattering from housing 44 to the outside of cleaning device 40. Thus, cleaning mechanism 60 cleans cleaning assist member 43.

Figure 4:
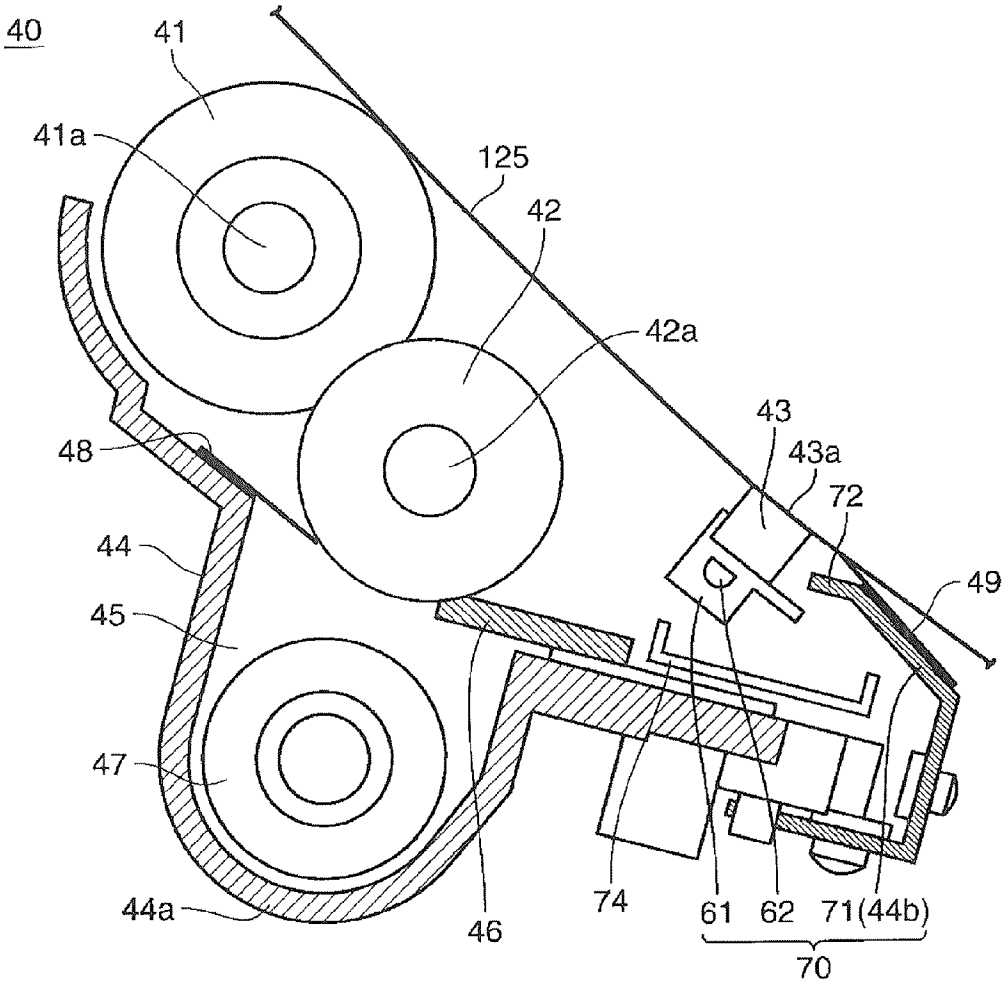
FIG. 4 schematically shows major elements of a cleaning device according to an embodiment, in a state where a cleaning assist member is in contact with an image bearing member.
Figure 5:
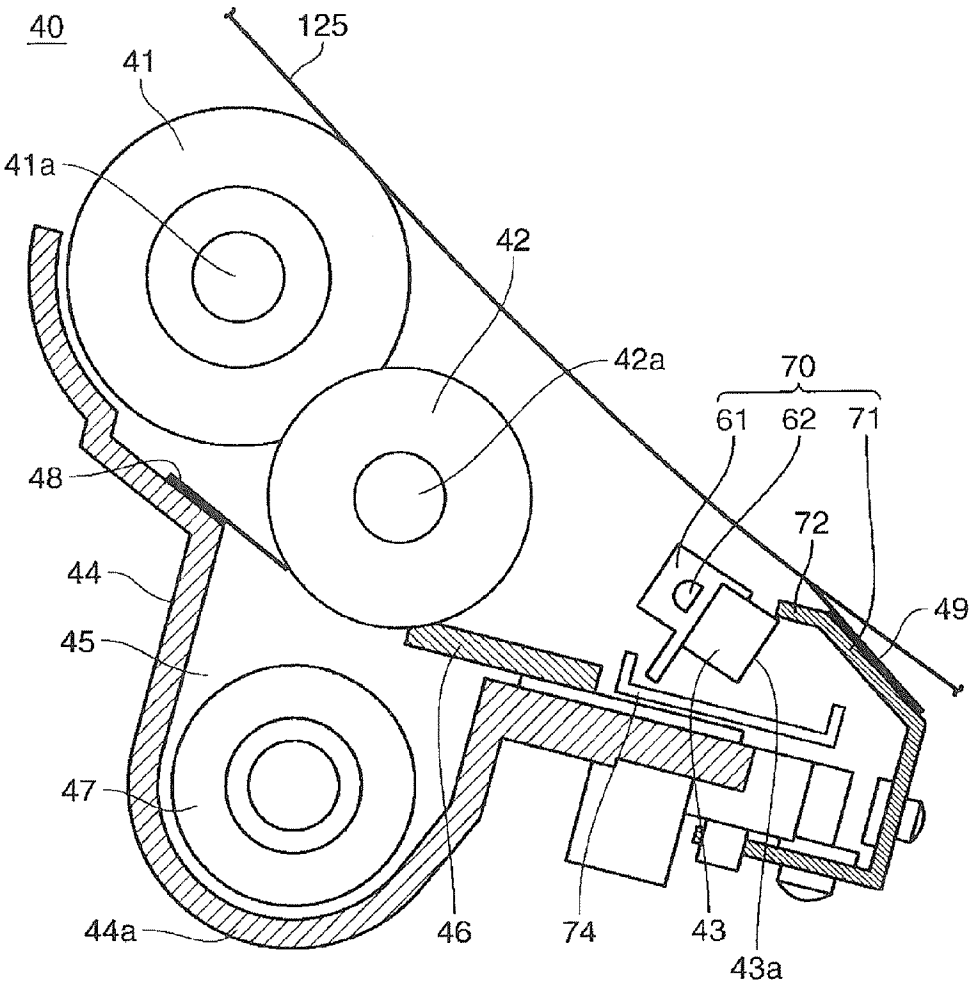
FIG. 5 schematically shows the major elements of the cleaning device according to the embodiment depicted in FIG. 4, in a state where the cleaning assist member is away from the image bearing member.

An embodiment of cleaning mechanism 70 is depicted in FIGS. 4 and 5. Specifically, FIG. 4 shows cleaning assist member 43 in contact with transfer belt 125. In contrast, FIG. 5 depicts cleaning assist member 43 moved away from transfer belt 125 by cleaning mechanism 70. Cleaning mechanism 70 includes scraper 71, support member 61 and rotating shaft. Scraper 71 may be a portion of side member 44*b* of housing 44. In some embodiments, scraper 71 may include tip 72 extending from the upstream side with respect to and toward cleaning assist member 43. An embodiment may include positioning tip 72 such that, when the cleaning assist member 43 rotates clockwise with the rotation of the rotating shaft 62, contact surface 43*a* of cleaning assist member 43 is rubbed against tip 72 as is shown in FIG. 5.

Referring now to FIG. 5, when rotating shaft 62 rotates according to a predetermined timing, cleaning assist member 43 is moved away from transfer belt 125. Contact surface 43*a* may then rub against tip 72 of scraper 71. Accordingly, residual toner adhered to contact surface 43*a* falls into housing 44. Thus, cleaning mechanism 70 cleans cleaning assist member 43. An embodiment may include toner receiver 74 provided in housing 44. Toner receiver 74 may be positioned to receive residual toner scraped off contact surface 43*a* by scraper 71. Both scattering of residual toner inside the housing and adhesion of residual toner to the fur brush roller and the sweep roller can be suppressed using a toner receiver. Toner receiver 74 may also be included in the embodiment of the cleaning device shown in FIGS. 2 and 3.

Figure 6:
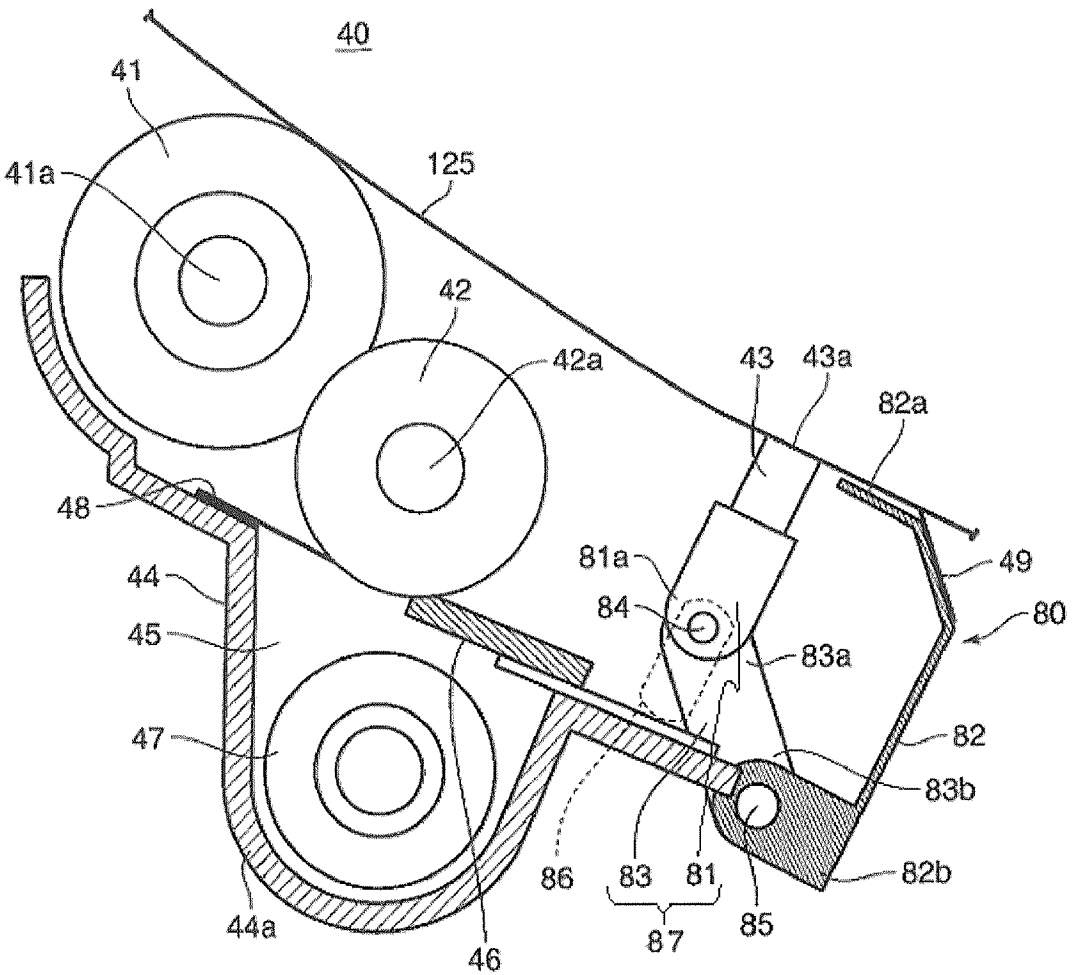
FIG. 6 schematically shows major elements of a cleaning device according to an embodiment, in a state where a cleaning assist member is in contact with an image bearing member.
Figure 7:
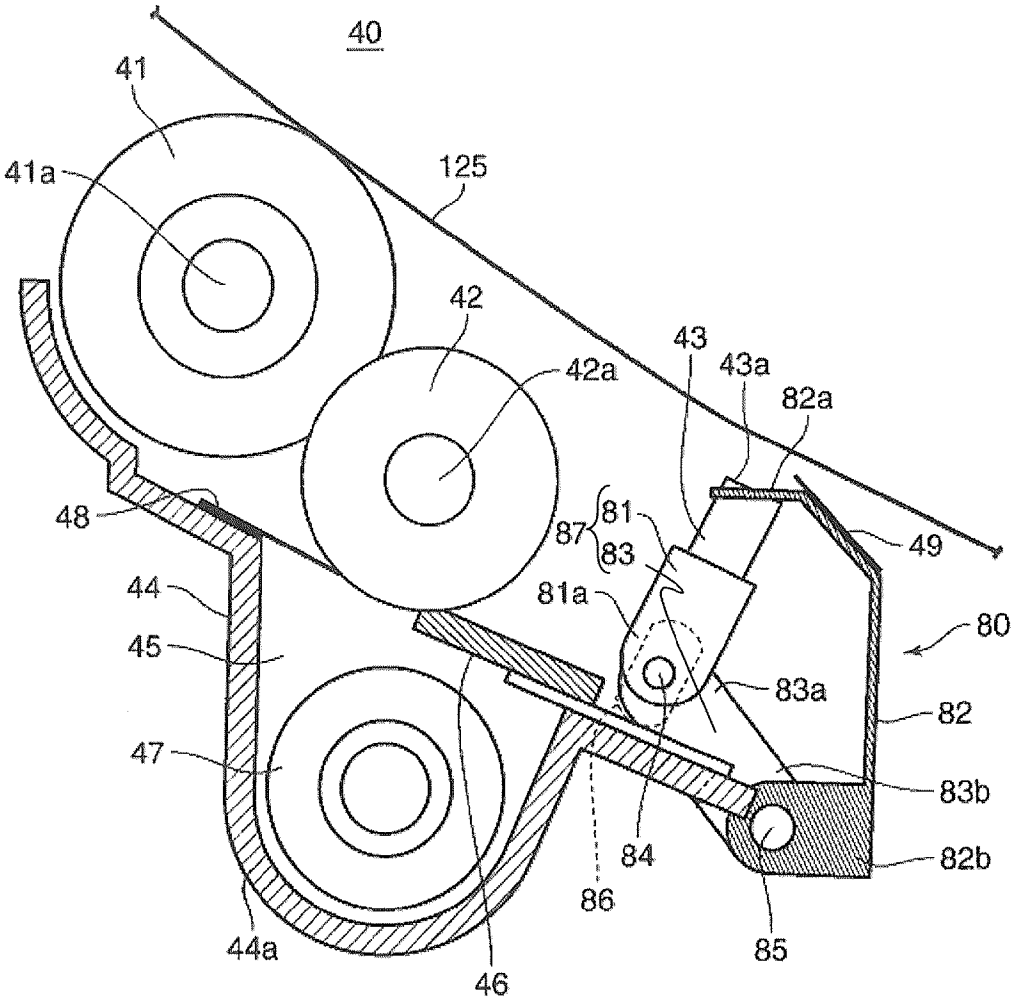
FIG. 7 schematically shows the major elements of the cleaning device according to the embodiment depicted in FIG. 6, in a state where the cleaning assist member is away from the image bearing member.

FIGS. 6 and 7 depict an embodiment of a cleaning mechanism. Specifically, FIG. 6 shows cleaning mechanism 80 where cleaning assist member 43 is in contact with transfer belt 125. In contrast, FIG. 7 shows a state where cleaning assist member 43 is moved away from transfer belt 125 by cleaning mechanism 80. As shown in FIGS. 6 and 7, cleaning mechanism 80 includes link mechanism 87 that links cleaning assist member 43 and scraper 82 together in order to clean cleaning assist member 43. In some embodiments, link mechanism 87 includes support member 81 and link member 83. Support member 81 may support cleaning assist member 43 such that contact surface 43*a* of cleaning assist member 43 is in contact with transfer belt 125. Link member 83 links end 81*a* of support member 81 and base 82*b* of scraper 82 together. As shown in FIGS. 6 and 7, an embodiment may include base 82*b* being positioned opposite tip 82*a* of scraper 82. End 81*a* of support member 81 and end 83*a* of link member 83 are linked together with linking shaft 84. Base 82*b* of scraper 82 and end 83*b* of the link member 83 are linked together with linking shaft 85. First linking shaft 84 is movable in a substantially vertical direction along guide 86 (shown by the dashed line) provided at an appropriate position in housing 44. In some embodiments, alternate configurations may be used.

Referring now to FIG. 7, cleaning mechanism 80 allows linking shaft 84 to move downward along guide 86 at a predetermined interval. As linking shaft 84 moves downward, cleaning assist member 43 moves away from transfer belt 125. In addition, tip 82*a* of scraper 82 moves, in conjunction with the downward movement of first linking shaft 84, such that tip 82*a* rubs against the contact surface 43*a* of cleaning assist member 43. Accordingly, residual toner adhered to contact surface 43*a* falls into housing 44. Thus, the cleaning mechanism may clean the cleaning assist member with the aid of the link mechanism.

Another embodiment of a cleaning mechanism is depicted in FIGS. 8 and 9. FIG. 8 shows cleaning mechanism 90 where cleaning assist member 43 is in contact with transfer belt 125. In contrast, FIG. 9 depicts cleaning assist member 43 in a position such that it is moved away from transfer belt 125 by the cleaning mechanism 90. As shown in FIG. 9, cleaning assist member may be brought into contact with sweep roller 42. In addition, some embodiments may include cleaning mechanism 90 electrically cleaning assist member 43. Cleaning mechanism 90 includes support member 91 that supports cleaning assist member 43 such that contact surface 43*a* of the cleaning assist member 43 is in contact with transfer belt 125. Rotating shaft 92 may extend through an opening provided in support member 91. Rotating shaft 92 may be a motor shaft rotated (counterclockwise in the drawings) by a motor (not shown). The axis of rotating shaft 92 may extend substantially parallel to rotating shafts 41*a* and 42*a* of fur brush roller 41 and sweep roller 42, respectively. The angle of rotation of the rotating shaft is set to allow the cleaning assist member to be moved away from the transfer belt during rotation. Further, cleaning assist member 43 may comes into contact with the peripheral surface of sweep roller 42. In some embodiments, sweep roller 42 may be negatively biased by bias source 95.

Referring now to FIG. 9, rotating shaft 92 may be set to rotate according to a predetermined timing to allow cleaning assist member 43 to be moved away from transfer belt 125. Further, rotation of rotating shaft 92 may allow contact surface 43*a* of cleaning assist member 43 to come into contact with the peripheral surface of sweep roller 42. In some embodiments, toner image on transfer belt 125 is positively biased at the secondary transfer position by secondary-transfer roller 113. Therefore, residual toner on transfer belt 125 remaining after the secondary transfer is positively charged. The positively charged residual toner may adhere to the rubbing member of cleaning assist member 43. Hence, by bringing the rubbing member into contact with the negatively biased peripheral surface of sweep roller 42, the residual toner adhered to the rubbing member can be electrically transferred to sweep roller 42. Residual toner may be transferred from the rubbing member to sweep roller 42. In some embodiments, the residual toner may be scraped off the peripheral surface of sweep roller 42 by cleaning blade 46. The residual toner collected from the fur brush roller and the sweep roller may fall into waste-toner chamber 45. Thus, in some embodiments, cleaning mechanism 90 may electrically clean cleaning assist member 43. In some embodiments, cleaning mechanisms may clean a cleaning assist member using both electrical and mechanical means. For example, cleaning mechanism 90 may allow for both electrical and mechanical cleaning of cleaning assist member 43.

In another embodiment, cleaning mechanism 90 may be configured such that bias source 96 is connected to support member 91 to allow support member 91 to be positively biased. In some embodiments, counter roller may be provided at a position facing cleaning assist member 43 with transfer belt 125 interposed therebetween. In some embodiments, such as embodiments providing for support member 91 to be electrically biased, counter roller 97 may be in contact with transfer belt 125 and may be grounded. Residual toner on transfer belt 125 may be charged at the secondary transfer position so as to have a positive polarity. In some embodiments, the polarity of the residual toner may be unstable. For example, residual toner may include negatively charged particles and neutral particles even after charging. In cleaning mechanism 90 where support member 91 has been positively biased, the residual toner on transfer belt 125 can be charged positively and uniformly. Uniformly charging the residual toner may allow an increase in the efficiency of residual toner collection. For example, fur brush roller 41 positioned downstream of cleaning assist member 43 may collect residual toner may efficiently collect residual toner. In an embodiment, when the rubbing member of cleaning assist member 43 is in contact with the sweep roller 42, support member 91 is disconnected from bias source 96 and is grounded.

In an embodiment of the cleaning device, the cleaning assist member may be cleaned by any of cleaning mechanisms 60, 70, 80, and 90 shown in FIGS. 2-9. Alternately, features of any of the cleaning mechanisms may be combined to clean a cleaning assist member. Cleaning the cleaning assist members may inhibit image failure caused by adhesion of residual toner on the cleaning assist member and/or the transfer belt.

In some embodiments, multiple cleaning devices may be positioned along transfer belt to remove residual toner.

As shown in FIGS. 2-9, sheet storage section 14 and the conveyance path of a sheet are positioned below the cleaning device 40. Further, cleaning device 40 may include housing 44 which encloses cleaning assist member 43 and cleaning mechanisms 60, 70, 80, or 90. This may suppress scattering of residual toner outside of the cleaning device 40. Thus, contamination of the sheet storage section and the conveyance path may be reduced.

FIGS. 2-9 depict cleaning device 40 having cleaning assist member 43 positioned upstream of fur brush roller 41. Alternatively, in some embodiments cleaning assist member 43 may be provided on downstream of fur brush roller 41. In the alternative case, any residual toner remaining can be collected by cleaning assist member 43 provided on downstream of the fur brush roller.

In the embodiments described above, illustrative predetermined timings according to which the cleaning assist member may be moved away from the transfer belt may correspond to one or more fixed or variable (e.g., irregular) times, time intervals, and/or events, etc. For example, the predetermined timing may correspond to a time at which and/or time period during which the cleaning assist member is and/or tends to be contaminated with toner. For example, during between image-output jobs, during calibration of the image forming apparatus 10, and in the event of sheet jamming, large amount of toner may adhere to the transfer belt and thus be conveyed to the cleaning device 40. Alternate embodiments may include configuring the cleaning assist member to be moved away from the transfer belt at predetermined times.

Those skilled in the art will understand that such predetermined timing may be implemented by one or more processors, (e.g., program-controlled processors), which may be included within image forming apparatus 10.

Having thus described in detail embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A cleaning device configured to clean an image bearing member, comprising:

a cleaning member provided downstream of a transfer position of a toner image and configured to collect residual toner from the image bearing member;

a cleaning assist member comprising a rubbing member configured to be pressed against the image bearing member so as to rub off the residual toner from the image bearing member;

a cleaning mechanism configured to move the cleaning assist member away from the image bearing member according to a predetermined timing so as to remove the residual toner adhered to the cleaning assist member; and a housing that houses the cleaning member, the cleaning assist member, and the cleaning mechanism; and wherein the cleaning mechanism comprises:

a scraper attached to the housing; and a mechanism configured to cause the rubbing member to be scraped by the scraper when the cleaning assist member is moved away from the image bearing member.

2. The cleaning device according to claim 1, wherein the cleaning mechanism comprises a mechanism configured to move the cleaning assist member away from the image bearing member by rotating the cleaning assist member such that the rubbing member faces downward.

3. The cleaning device according to claim 1, wherein the cleaning mechanism comprises a link mechanism that links the cleaning assist member and the scraper together such that the scraper scrapes the rubbing member when the cleaning assist member is moved away from the image bearing member.

4. The cleaning device according to claim 1, wherein the image bearing member serves as a transfer belt.

5. The cleaning device according to claim 1, wherein the cleaning member is electrically biased with an opposite polarity to a charge of the residual toner on the image bearing member, the cleaning member electrically collecting the residual toner while being in contact with the image bearing member.

6. The cleaning device according to claim 1, wherein the rubbing member comprises a flocked sheet.

7. The cleaning device according to claim 1, wherein the cleaning assist member is provided on the downstream side in the movement direction with respect to the cleaning member.

8. A cleaning device configured to clean an image bearing member, comprising:

a cleaning member provided downstream of a transfer position of a toner image and configured to collect residual toner from the image bearing member;

a cleaning assist member comprising a rubbing member configured to be pressed against the image bearing member so as to rub off the residual toner from the image bearing member;

a cleaning mechanism configured to move the cleaning assist member away from the image bearing member according to a predetermined timing so as to remove the residual toner adhered to the cleaning assist member; and a housing that houses the cleaning member, the cleaning assist member, and the cleaning mechanism, and wherein the cleaning mechanism comprises a mechanism configured to bring the rubbing member into contact with the cleaning member when the cleaning assist member is moved away from the image bearing member.

9. The cleaning device according to claim 8, wherein the cleaning member comprises:

a fur brush roller provided in contact with the image bearing member so as to collect the residual toner from the image bearing member; and a sweep roller provided in contact with the fur brush roller so as to receive the residual toner collected by the fur brush roller, and wherein the cleaning mechanism further comprises:

a mechanism configured to bring the rubbing member into contact with the sweep roller when the cleaning assist member is moved away from the image bearing member.

10. The cleaning device according to claim 9, wherein the fur brush roller and the sweep roller are conductive members capable of being electrically biased.

11. The cleaning device according to claim 10, wherein at least one of the fur brush roller and the sweep roller is electrically biased with an opposite polarity to a charge of the residual toner on the image bearing member.

12. The cleaning device according to claim 11, further comprising a counter roller facing the fur brush roller with the image bearing member interposed therebetween, the counter roller being electrically grounded while being in contact with the image bearing member.

13. The cleaning device according to claim 8, wherein the cleaning assist member is provided on the upstream side in the movement direction with respect to the cleaning member and has conductivity so as to be electrically biased such that the residual toner has a uniform polarity.

14. The cleaning device according to claim 13, wherein the cleaning assist member is electrically biased with a same polarity as a charge of the residual toner on the image bearing member.

15. The cleaning device according to claim 14, further comprising a counter roller facing the cleaning assist member with the image bearing member interposed therebetween, the counter roller being electrically grounded while being in contact with the image bearing member.

16. The cleaning device according to claim 14, wherein the state where the rubbing member of the cleaning assist member is in contact with the cleaning member, the cleaning assist member is not electrically biased and is electrically grounded.

17. An image forming apparatus comprising:

an image forming section configured to form a toner image;

an image bearing member configured to bear the toner image;

a cleaning device configured to collect residual toner on the image bearing member remaining after transfer of the toner image onto a sheet; and an apparatus body housing the image forming section, the image bearing member, and the cleaning device, wherein the cleaning device comprises the cleaning device according to claim 6.

18. An image forming apparatus comprising:

an image forming section configured to form a toner image;

an image bearing member configured to bear the toner image;

a cleaning device configured to collect residual toner on the image bearing member remaining after transfer of the toner image onto a sheet; and an apparatus body housing the image forming section, the image bearing member, and the cleaning device, wherein the cleaning device comprises the cleaning device according to claim 1.

* * * * *

UNITED STATES PATENT AND TRADEMARK OFFICE

CERTIFICATE OF CORRECTION

PATENT NO. : 7,912,401 B2
APPLICATION NO. : 12/551756
DATED : March 22, 2011
INVENTOR(S) : Mutsumi Inoue It is certified that error appears in the above-identified patent and that said Letters Patent is hereby corrected as shown below:

Column 14, line 9 in claim 17

"according to claim 6." should be changed to -- according to claim 8. --

Signed and Sealed this
Tenth Day of May, 2011

David J. Kappos

David J. Kappos
*Director of the United States Patent and Trademark Office*